US012194589B2

(12) United States Patent
Keeble

(10) Patent No.: US 12,194,589 B2
(45) Date of Patent: Jan. 14, 2025

(54) GRINDING/POLISHING DEVICES WITH RECALL

(71) Applicant: Illinois Tool Works Inc., Glenview, IL (US)

(72) Inventor: Michael E. Keeble, Libertyville, IL (US)

(73) Assignee: Illinois Tool Works Inc., Glenview, IL (US)

( * ) Notice: Subject to any disclaimer, the term of this patent is extended or adjusted under 35 U.S.C. 154(b) by 211 days.

(21) Appl. No.: 17/208,490

(22) Filed: Mar. 22, 2021

(65) Prior Publication Data

US 2021/0299815 A1 Sep. 30, 2021

Related U.S. Application Data

(60) Provisional application No. 63/002,923, filed on Mar. 31, 2020.

(51) Int. Cl.

| | |
|---|---|
| ***B24B 37/015*** | (2012.01) |
| ***B24B 37/27*** | (2012.01) |
| ***B24B 37/34*** | (2012.01) |

(52) U.S. Cl.

CPC ..... *B24B 37/015* (2013.01); *B24B 37/27* (2013.01); *B24B 37/34* (2013.01)

(58) Field of Classification Search

CPC ..... B24B 7/16; B24B 37/005; B24B 37/015; B24B 37/34; B24B 49/16; B24B 55/02

See application file for complete search history.

(56) References Cited

U.S. PATENT DOCUMENTS 4,680,893 A 7/1987 Cronkhite
4,873,792 A * 10/1989 Linke ..... B24B 49/04 451/14

(Continued)

FOREIGN PATENT DOCUMENTS

CN 108527010 9/2018
JP 2015203969 11/2015

OTHER PUBLICATIONS

Int'l Search Report and Written Opinion AppIn No. PCT/US2021/023671 mailed Sep. 23, 2021.

(Continued)

*Primary Examiner* — Joel D Crandall
(74) *Attorney, Agent, or Firm* — McAndrews, Held & Malloy, Ltd.

(57) ABSTRACT

A grinder/polisher comprises a specimen holder, a platen, an actuator configured to move at least one of the specimen holder and the platen, an input device, a machine readable storage device, and a controller. The input device includes a plurality of quick-recall inputs and is configured to receive grinding/polishing parameter inputs representative of grinding/polishing parameters, The grinding/polishing parameters comprise at least two of a cycle time, a platen speed, a specimen speed, a platen direction, a specimen direction, and an applied load. The quick-recall inputs are selectable on a same interface as the user parameter inputs. The controller is configured to save to the machine readable storage device a plurality of user-selected grinding/polishing parameters based on inputs received by the input device, associate the parameters with one of the quick-recall inputs, configure the parameters in response to selection of the quick-recall inputs, and perform an operation according to the parameters.

18 Claims, 5 Drawing Sheets

(56) References Cited

U.S. PATENT DOCUMENTS

| | | | | |
|---|---|---|---|---|
| 7,070,067 | B1 * | 7/2006 | Buchanan | B24B 57/02 222/64 |
| 2003/0182015 | A1 | 9/2003 | Domaille | |
| 2006/0035562 | A1 * | 2/2006 | Sarfati | G02B 6/3863 451/41 |
| 2009/0318059 | A1 * | 12/2009 | Shewey | B24B 37/04 451/10 |
| 2014/0030967 | A1 * | 1/2014 | Hart | G01N 1/286 451/364 |
| 2019/0389032 | A1 * | 12/2019 | Keeble | B24B 37/015 |

OTHER PUBLICATIONS

Siemens: "Step by step to the digital factory—Manage My Programs at the Siemens Geared Motor Factory", Apr. 21, 2017 (Apr. 21, 2017), p. 1, XP054981887, Retrieved from the Internet: URL: https://www.youtube.com/watch?v=JCYx71mVPKw [retrieved on Jun. 10, 2021].

Buehler, AutoMet 250 / 300 Pro Grinder-Polisher, Owner's Manual, MA497258_2.0, Jun. 2019.

European Examination Report Appln No. 21720065.8 dated Feb. 21, 2024.

European Examination Report Appln No. 21720065.8 dated Sep. 24, 2024.

Japanese Office Action AppIn No. 2022-559725 dated Nov. 15, 2024.

* cited by examiner

GRINDING/POLISHING DEVICES WITH RECALL

RELATED APPLICATIONS

The present application claims the benefit of U.S. Provisional Patent Application Ser. No. 63/002,923, filed Mar. 31, 2020, entitled "GRINDING/POLISHING DEVICES WITH RECALL." The entirety of U.S. Provisional Patent Application Ser. No. 63/002,923 is expressly incorporated herein by reference.

BACKGROUND

This disclosure relates generally to grinding/polishing systems and, more particularly, to grinding/polishing devices with recall.

Grinding and polishing operations are performed on specimens for numerous purposes and across a vast array of sectors and industries. In some applications, surface preparation of a specimen by grinding/polishing operations is a prerequisite to specimen testing, such as microscopic examination, which is relied on to test materials and components, for example, in the manufacturing sector. Grinding/polishing devices are capable of performing both grinding operations and polishing operations to work a specimen to a required finish for a particular application.

As may be expected, a need remains for grinding/polishing devices and methods that work a specimen to a desired specification within tolerances necessitated by an application. Yet, grinding/polishing devices often have limited user control. Often times, grinding/polishing devices may be difficult to setup and control, and require demanding setup times by a user. Such inefficiencies, and others, may be taxing on the user and lead to lost time and increased operational cost. It would be advantageous to provide improved grinding/polishing devices and methods.

SUMMARY

In embodiments, a grinder/polisher comprises a specimen holder configured to secure a specimen, a platen, an actuator configured to move at least one of the specimen holder and the platen, an input device comprising a plurality of quick-recall inputs and being configured to receive grinding/polishing parameter inputs representative of grinding/polishing parameters, the grinding/polishing parameters comprising at least two of a cycle time, a platen speed, a specimen speed, a platen direction, a specimen direction, and an applied load. The quick-recall inputs are selectable on a same interface as the user parameter inputs. In embodiments, there is a machine readable storage device, and a controller. The controller is configured to save to the machine readable storage device a plurality of user-selected grinding/polishing parameters based on the grinding/polishing parameter inputs received by the input device, and associate the plurality of user-selected grinding/polishing parameters with one of the quick-recall inputs. The controller may further be configured to, in response to selection of one of the quick-recall inputs, configure the grinding/polishing parameters based on the grinding/polishing parameters stored in the machine readable storage device in association with the selected one of the quick-recall inputs, as well as control the actuator to perform a grinding/polishing operation in accordance with the configured grinding/polishing parameters.

The grinder/polisher may further comprise a water dispenser configured to provide cooling water to the specimen, where the grinder/polisher parameters further include water on/off. In such embodiments, the controller is further configured to control the water dispenser in accordance with a selected cycle time and water on/off. In other embodiments, the actuator comprises a motor and a driver actuator, and the controller is configured to control the motor to rotate at least one of the specimen holder and the platen in accordance with selected grinding/polishing parameters. The controller in examples is also configured to drive actuator to press the specimen or the platen into the other of the specimen and the platen in accordance with a selected load applied.

In yet other embodiments, the grinder/polisher comprises a fluid dispenser configured to provide a fluid to the specimen, and the grinder/polisher parameters further includes fluid on/off and fluid dispensation rate. The controller may be further configured to control the fluid dispenser in accordance with a selected cycle time, fluid on/off, and fluid flow dispensation rate. The input device in embodiments is a touch-screen display configured to display the quick-recall inputs and the plurality of grinder/polisher parameters, and may include a home screen.

The controller may also be configured to save to the machine readable storage device the plurality of user-selected grinder/polisher parameters upon a user selecting and holding one of the plurality of quick-recall inputs. At least one of the plurality of quick-recall inputs in embodiments is accessible without accessing a menu of the input device, and in embodiments is immediately accessible to the user. The grinding/polishing parameters may also comprise a cycle time, at least one of a platen speed a specimen speed, at least one of a platen direction and a specimen direction, and an applied load.

In embodiments, a non-transitory machine readable storage device comprises machine readable instructions which, when executed, cause a controller to save to the machine readable storage device a plurality of user-selected grinding/polishing parameters based on grinding/polishing parameter inputs received by an input device, associate the plurality of user-selected grinding/polishing parameters with one of a plurality of quick-recall inputs of an input device, in response to selection of one of the quick-recall inputs of the user interface input device, configure the grinding/polishing parameters based on the grinding/polishing parameters stored in the machine readable storage device in association with the selected one of the quick-recall inputs, and control an actuator of a grinder/polisher that is configured to move at least one of a specimen holder and a platen of the grinder/polisher to perform a grinding/polishing operation in accordance with the configured grinding/polishing parameters. In such embodiments, the grinding/polishing parameters may comprise at least two of a cycle time, a platen speed, a specimen speed, a platen direction, a specimen direction, and an applied load.

The grinder/polisher parameters may further include at least one of water on/off, and the instructions, when executed, cause the controller to control the water dispenser in accordance with a selected cycle time and water on/off. In embodiments, the actuator comprises a motor and a driver actuator, and the instructions, when executed, cause the controller to control the motor to rotate at least one of the specimen holder and the platen in accordance with selected grinding/polishing parameters, and the drive actuator to press the specimen or the platen into the other of the specimen and the platen in accordance with a selected load applied. In other embodiments, grinder/polisher further comprises a fluid dispenser configured to provide a fluid to the specimen, and the grinder/polisher parameters further include fluid on/off and fluid dispensation rate, and the instructions, when executed, cause the controller to control the fluid dispenser in accordance with a selected cycle time, fluid on/off, and fluid flow dispensation rate.

In further embodiments of the non-transitory machine readable storage device, the input device comprises a touch-screen display, and the instructions, when executed, cause the controller to display on the touch screen the quick-recall inputs and the plurality of grinder/polisher parameters. In yet other embodiments, the instructions, when executed, cause the controller to display on the touch screen display a home screen, wherein at least one of the plurality of quick-recall inputs is displayed on and selectable from the home screen. In another aspect, the instructions, when executed, may cause the controller to save to the machine readable storage device the plurality of user-selected grinder/polisher parameters upon a user selecting and holding one of the plurality of quick-recall inputs. The plurality of quick-recall inputs in embodiments are accessible without accessing a menu of the user interface input device, and in embodiments are immediately accessible to a user. The grinding/polishing parameters in embodiments comprise a cycle time, at least one of a platen speed a specimen speed, at least one of a platen direction and a specimen direction, and an applied load.

BRIEF DESCRIPTION OF THE DRAWINGS

The drawings are not necessarily to scale. Where appropriate, similar or identical reference numbers are used to refer to similar or identical elements.

DETAILED DESCRIPTION

Figure 1:
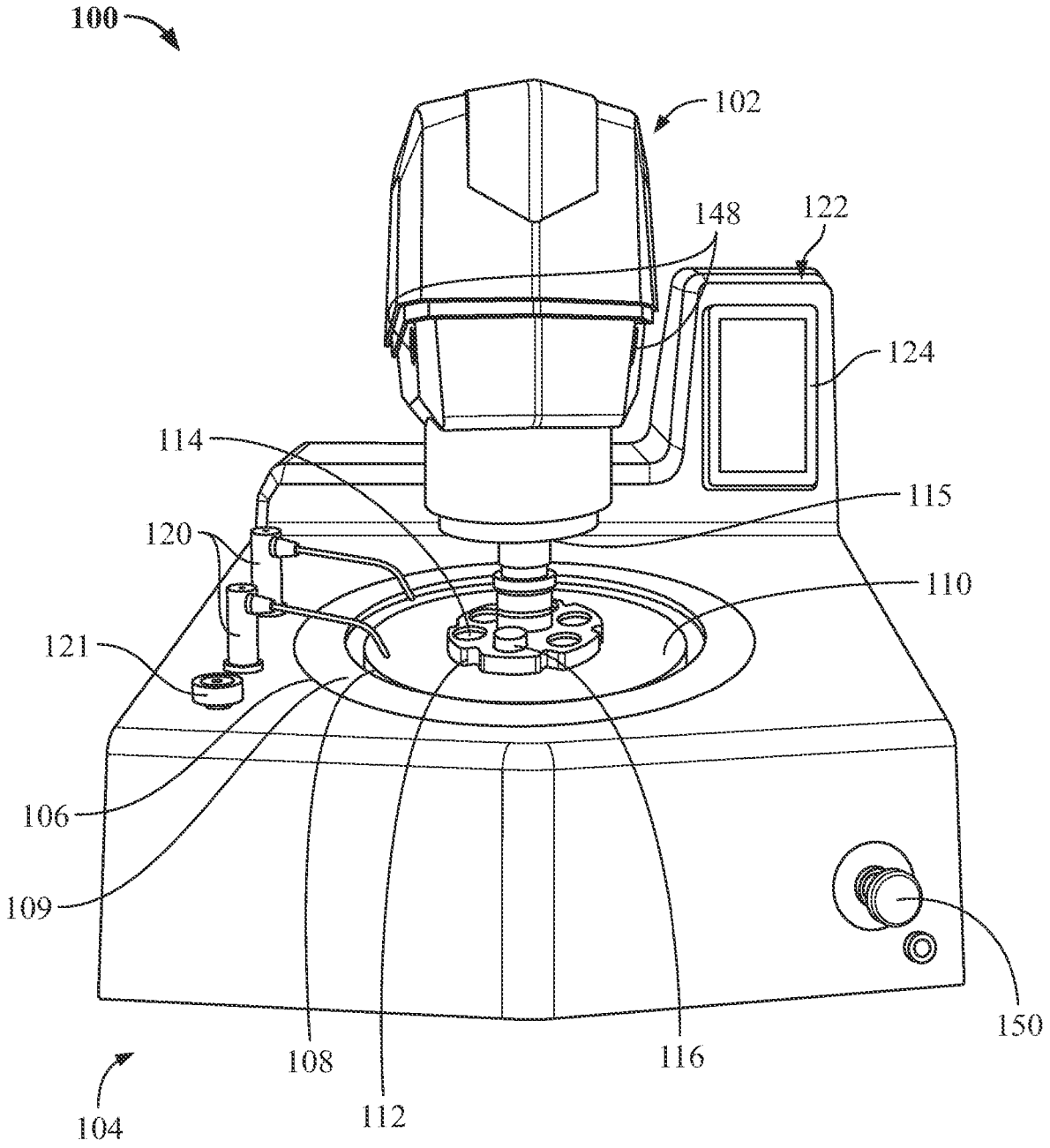
FIG. 1 illustrates an example grinding/polishing device.

The present disclosure is directed generally to systems, methods, and apparatuses for grinding/polishing devices. Preferred embodiments will be described with reference to the figures of the accompanying drawings. In the following description, well-known functions or constructions are not described in detail, since such descriptions would obscure the disclosure in unnecessary detail.

For the purpose of promoting an understanding of the principles of the claimed technology and presenting its currently understood, best mode of operation, reference will be now made to the embodiments illustrated in the drawings and specific language will be used to describe the same. It will nevertheless be understood that no limitation of the scope of the claimed technology is thereby intended, with such alterations and further modifications in the illustrated device and such further applications of the principles of the claimed technology as illustrated therein being contemplated as would typically occur to one skilled in the art to which the claimed technology relates.

As used herein, the word "exemplary" means "serving as an example, instance, or illustration." The embodiments described herein are not limiting, but rather are exemplary only. It should be understood that the described embodiments are not necessarily to be construed as preferred or advantageous over other embodiments. Moreover, the term "embodiments" does not require that all disclosed embodiments include the discussed feature, advantage, or mode of operation.

As utilized herein the terms "circuits" and "circuitry" refer to physical electronic components (i.e. hardware) and any software and/or firmware ("code") which may configure the hardware, be executed by the hardware, and or otherwise be associated with the hardware. As used herein, for example, a particular processor and memory may comprise a first "circuit" when executing a first set of one or more lines of code and may comprise a second "circuit" when executing a second set of one or more lines of code. As utilized herein, "and/or" means any one or more of the items in the list joined by "and/or". As an example, "x and/or y" means any element of the three-element set {(x), (y), (x, y)}. In other words, "x and/or y" means "one or both of x and y". As another example, "x, y, and/or z" means any element of the seven-element set {(x), (y), (z), (x, y), (x, z), (y, z), (x, y, z)}. In other words, "x, y and/or z" means "one or more of x, y and z". As utilized herein, the term "exemplary" means serving as a non-limiting example, instance, or illustration. As utilized herein, the terms "e.g." and "for example" set off lists of one or more non-limiting examples, instances, or illustrations. As utilized herein, circuitry is "operable" to perform a function whenever the circuitry comprises the necessary hardware and code (if any is necessary) to perform the function, regardless of whether performance of the function is disabled or not enabled (e.g., by an operator-configurable setting, factory trim, etc.).

Figure 2:
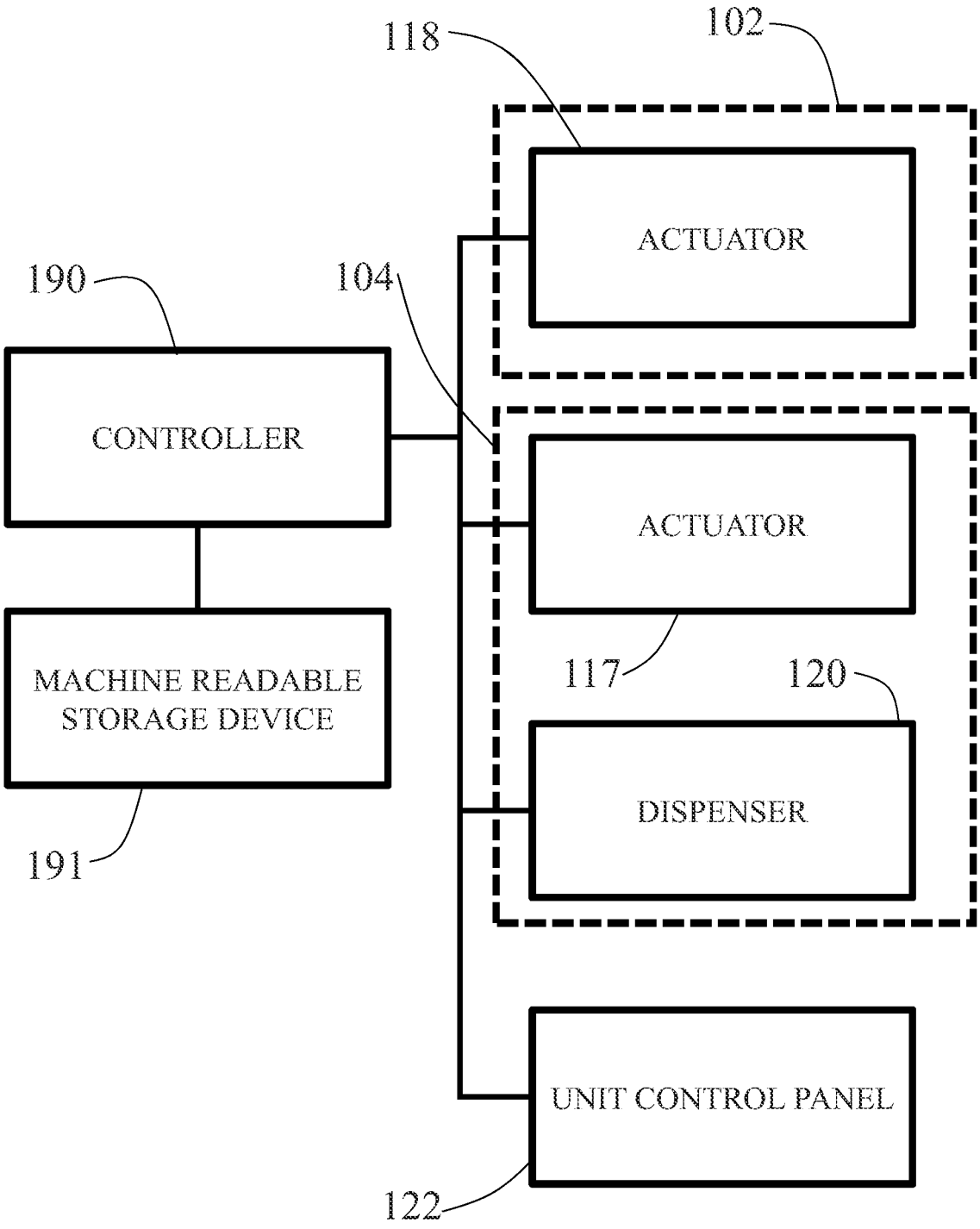
FIG. 2 is a block diagram of components of the grinding/polishing device of FIG. 1.
Figure 3:
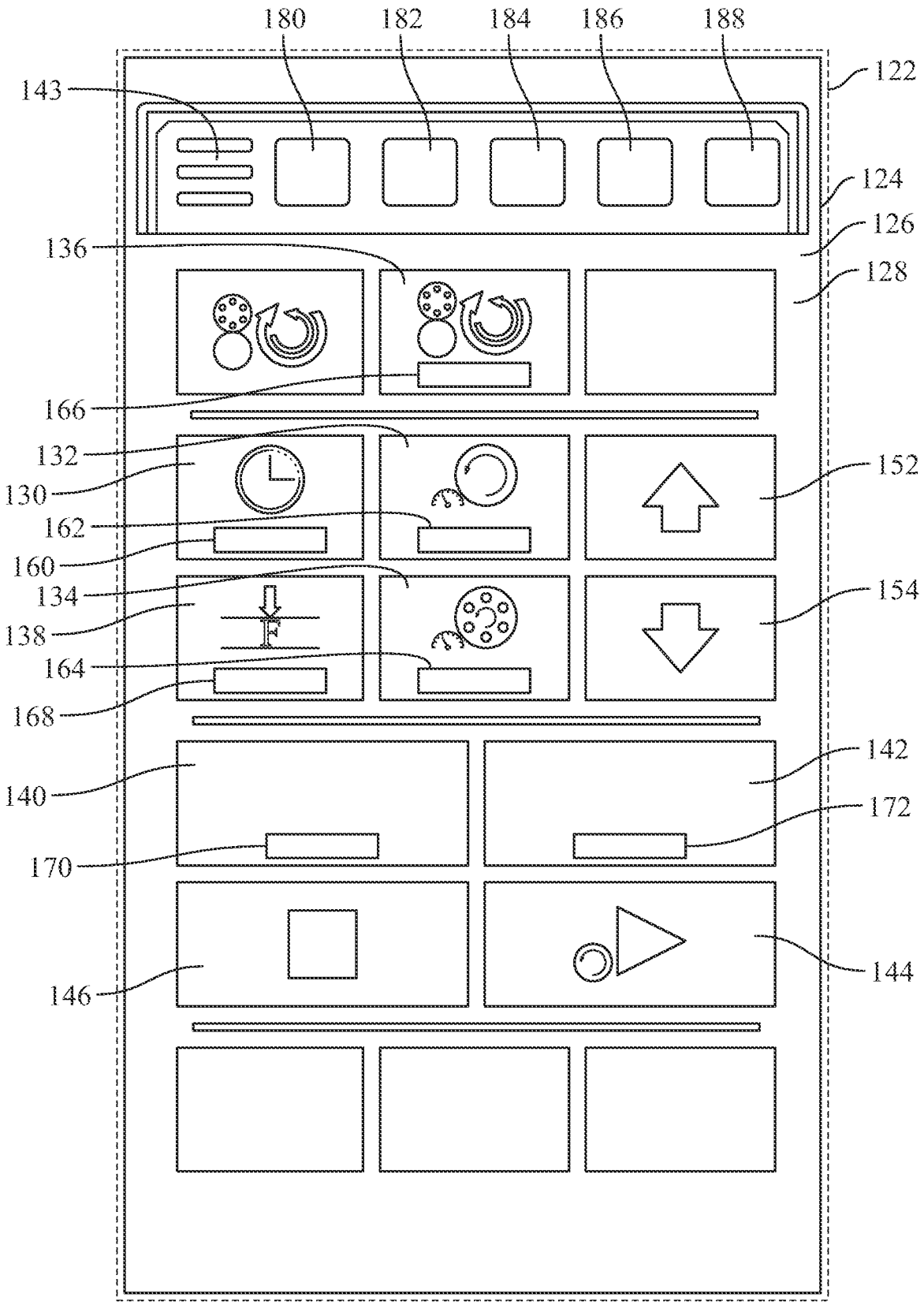
FIG. 3 illustrates an example input device of the grinding/polishing device of FIG. 1.

An example of a grinding/polishing device for performing grinding and polishing operations on a workpiece or specimen is shown in FIGS. 1-3. With reference to FIG. 1, a grinding/polishing device 100 includes a power head assembly 102 with a specimen holder 112 with specimens 116 (one shown), a cabinet or base 104 with a bowl 106, a controller 190 (FIG. 2), and an input device or unit control panel 122.

With continued reference to FIG. 1, the bowl 106 forms an opening in the base 104 in the embodiment depicted. The bowl 106 includes a removable bowl liner (not shown), such as a transparent plastic bowl liner, to prevent accumulation of debris, contaminant, and residue in the bowl. A splash guard (109) may further be positioned around the bowl 106 to contain the fluid in the bowl and minimize over-spray, and to prevent items from unintendedly entering the bowl or contacting a moving component of the grinding polishing device, such as the platen 108 or specimen holder 112.

The platen 108 is installed in the bowl 106. A pad 110 is secured to the top of the platen 108 and is configured to contact the specimens 116 during a grinding/polishing cycle. Many types of pads 110 may be used in a grinding/polishing operation. For example, the pad 110 may be a grinding disc, such as a silicon carbide grinding disc or a diamond grinding disc. In other embodiments, the pad 110 may be a polishing pad. The platen 108 is operably connected to an actuator 117 (FIG. 2). As an example, the underside of the platen may include openings for receiving drive pins on the top of a drive plate of an actuator to secure the platen to the actuator, but many other mechanisms may be used to secure the platen to the actuator.

The actuator 117 is controlled by the controller 190 to rotate, oscillate, or otherwise move the platen 108 to work the specimen 116 during a grinding/polishing operation. The actuator 117 in embodiments is a bi-directional motor configured to rotate the platen 108 at selected speeds and in either direction. In other embodiments, the actuator includes a motor operable to oscillate or otherwise move the platen so as to work the specimen. In some embodiments, the actuator may further be configured to move the platen towards or away from the specimen in order to adjust the load or force applied between the platen and specimen (e.g., a linear-type actuator controlled to move or drive the platen towards and away from the specimen). Many types of actuators may be used to facilitate a grinding/polishing operation.

The power head assembly 102 is secured to the base 104 and positions the specimen holder 112 with respect to the platen 108. In the embodiment depicted, the specimen holder 112 includes a number of specimen receiving slots 114 that hold specimens 116 (one shown) subject to a grinding/polishing operation by the device 100. The specimen holder 112 is operably connected to an actuator 118 (FIG. 2) of the power head assembly 102. In the embodiment shown, the specimen holder 112 is removably secured to the actuator 118 via a chuck 115. The actuator 118 is controlled by controller 190 to rotate, oscillate, or otherwise move the specimen holder 112 (and specimen 116) with respect to the platen 108 (and pad 110) to work the specimen 116 during a grinding/polishing operation. The actuator 118 in the embodiment shown includes a bi-directional motor configured to rotate the specimen holder 112 at selected speeds and in either direction, and further includes a linear-type actuator configured to press the specimen holder 112 (with specimen 116) towards or away from the platen 108 in order to adjust the load or force applied between the specimen and platen. In other embodiments, the actuator is configured to oscillate or move the specimen holder 112 with respect to the platen during an operation. Any desired actuator may be used.

Fluid dispenser 120 is located on the base 104 and positioned to dispense water and, in embodiments as the one depicted, may dispense other types of fluid onto the platen 108. Fluid dispensed onto the platen 108 may be collected in the bowl 106, and drained as needed. The dispenser includes valves that may be operated to control the dispensation flow rate. In embodiments, controller 190 operates the dispenser to turn the dispenser on and off and to adjust the flow rates. In the embodiment shown, a manual control knob 121 is also positioned on the base 106 and operable to control the volume of flow rate delivered by the dispensers 120.

Fluids that may be dispensed may include, for example, water, suspensions including diamond and other suspensions, polishing suspensions, lubricants and other fluids. In certain embodiments, one or more fluids may be supplied by one or more dispensers. In embodiment where multiple fluids are dispensed, such as water and another type of fluid, the water and the other fluid(s) are provided by respective supply lines (not shown), such as water service lines and fluid supply lines. In embodiments, water and other fluids are supplied from a reservoir or canister tank located on the device or located remotely. The controller may also provide automatic control of the fluid which may be selected by the user at the control panel. In embodiments, controller 190 operates the dispenser to turn the dispenser on and off and to adjust the flow rates.

While in the embodiment depicted the dispenser may dispense water from one nozzle and another type of fluid from a second nozzle shown, in other embodiments, the second nozzle may be part of a second dispenser that is a standalone unit and separate from the base 104. In such embodiments, the fluid flow from may be controlled by the standalone unit, for example, manually by a knob or by a controller of the standalone dispenser unit. The second nozzle may be positionable next to the device 100 and, in embodiments, secured to the base 104.

The unit control panel 122 displays, among other things, grinding/polishing device data and information, and receives input from a user. In embodiments, the unit control panel may include various buttons, knobs, switches, sliders, displays, touch screens, touch pads, lights, indicia, and so on, to display information and receive input from a user. The Unit control panel may further include other components, such as peripheral device, audio circuits and speakers, microphones, communications devices (wired or wireless), and other components as will be recognized. In the embodiment depicted, unit control panel 122 has a touch-sensitive display 124.

Turning to FIG. 2, the control circuitry or controller 190 comprises circuitry (e.g., a microcontroller and memory such as a non-transitory machine readable storage device 191) operable to process data from the actuators 117, 118, the dispenser 120, and the unit control panel 122. For example, the controller 190 may include processor(s) and/or other logic circuitry that controls the operations of the grinding/polishing device. Example processor(s) may include one or more microprocessors, such as one or more "general-purpose" microprocessors, one or more special-purpose microprocessors and/or ASICS, one or more microcontrollers, and/or any other type of processing and/or logic device. For example, the controller 190 may include one or more digital signal processors (DSPs). The controller 190 is operable to receive user input signals from the unit control panel 122 and, in response, control components of the grinding/polishing device such as the actuators, dispensers, components thereof, and other elements of the device.

Turning to FIG. 3, the unit control panel 122 in the embodiment shown includes a touchscreen display 124 with a graphical user interface 126 to an operator. The graphical user interface 126 in embodiments provides various screens that display information and controls for the grinding/polishing device, including various grinding/polishing parameters. The graphical user interface 126 may have a number of different screens, menus, display formats, etc., that are selectable by a user to view information and provide input.

Graphical user interface 126 may further include a home screen 128 which, in embodiments, is a default screen that is displayed by the control panel 122, for example, when powered on. The home screen 128 provides a user with information and enables user input that is immediately accessible to the user, for example, without requiring navigation to other screens, navigating through menus, etc. In embodiments, the home screen 128 is displayed by default upon powering-on the device. In other embodiments, the contents of the example home screen 128 of FIG. 3 are provided on one or more screens accessible through one or more navigation actions on the interface 126.

The home screen 128 may include a number of grinding/polishing parameter inputs, such as the grinding/polishing parameter inputs 130-142 depicted, that are associated with various grinding/polishing parameters. The grinding/polishing parameter inputs enable a user to adjust various grinding/polishing parameters for a grinding/polishing operation. Example grinding/polishing parameters include device cycle on/off and cycle time, platen speed (e.g., the rotations or oscillations per minute of a rotating or oscillating platen), rotation direction of the platen, specimen holder speed (e.g., the rotations or oscillations per minute of a rotating or oscillating specimen holder), rotation direction of the specimen holder, fluid dispenser(s) on/off (e.g., whether a water dispenser and/or dispenser for a fluid other than water is on/off), fluid dispenser(s) flow rate, load applied (e.g., the force applied between the platen and the specimen by, for example, operating an actuator to press the platen or the specimen holder into the other of the platen or specimen holder), and so forth.

The grinding/polishing parameters may be adjusted with the parameter inputs 130-142 in various ways. For example, a parameter may be toggled on and off by pressing the input on the touchscreen. The input 130-142 may, for example, change in appearance when toggled on/off, such as by changing color or brightness, a change in indicia or any other change to indicate that the input has been toggled. In embodiments, a parameter may be adjusted by selecting on the display 124 the parameter input 130-142 associated with the particular grinding/polishing parameter a user intends to change, and adjusting the value associated with the parameter upwards or downwards by selecting the adjustment inputs 152 or 154, respectively, until the desired value is reached. In the embodiment depicted in FIG. 3, the adjustment inputs 152 and 154 have indicia in the form of arrows to indicate adjustment upwards (e.g., increase value) and downwards (e.g., decrease value). Any desirable indicia may be utilized to convey the function of the input.

The parameter inputs 130-142 in the embodiment shown also display grinding/polishing parameter information 160-172 associated with the parameter. The parameter information 160-172 in embodiments is updated as the parameters are, for example, toggled, (e.g., on/off) or adjusted by the user. The parameter information 160-172 may include the on/off, cycle time selected (e.g., "10 minutes," "0:10," etc.), the rotation or oscillation speed selected (e.g., "50 rpm," "80 rpm," etc.), on/off, direction of rotation (e.g., indicated by an arrow), load applied (e.g., "8 lbs," "35.5 N," etc.), and so forth, depending on the particular grinding/polishing parameter associated with the input.

In the particular embodiment of FIG. 3, grinding/polishing parameters are assigned to each parameter input 130-142. Parameter input 130 is a cycle time input and is adjustable to set the amount of time that controller 190 will control the grinding/polishing device to operate a cycle. The cycle time input 130 may include indicia, such as a clock logo as depicted in FIG. 3, or other indicia, such as text, numerals, characters, graphics, and so forth, to convey to a user that the input is associated with cycle time. The parameter information 160 for cycle time input 130 displays the current time setting for a cycle (e.g., 10 minutes, 12 minutes, etc.). To adjust the cycle time, a user may select the cycle time input 130 and then press the adjustment inputs 152 or 154 to adjust the time upwards or downwards. The parameter information 160 will change as the user adjusts the cycle time with the adjustment inputs 152, 154. In one example, pressing the adjustment inputs 152, 154 a single time adjusts the time in 10-second increments. In other examples, the time could be adjusted in increments of 1 second, 30 seconds, one minute, or any other desired increment. In certain embodiments, the time may also be manually entered, for example, with a numeric pad input or keyboard on the screen.

Parameter input 132 is a platen rotation speed input and is adjustable to set the speed at which the controller 190 during a cycle operates the actuator 117 to rotate the platen. The platen rotation speed input 132 includes a graphical indicia indicative of the platen speed, but any other indicia may be utilized. The parameter information 162 for the platen rotation speed input 132 displays the current speed setting for the cycle (e.g., 50 rpms, 80 rpms, 0 rpms/off, etc.). The platen rotation speed input 132 may be selected and the speed adjusted with the adjustment inputs 152, 154, or with another input such as a numeric pad or keyboard.

Parameter input 134 is a specimen holder rotation speed input and is adjustable to set the speed at which the controller 190 during a cycle operates the actuator 118 to rotate the specimen holder. The specimen holder rotation speed input 134 includes a graphical indicia indicative of the specimen holder speed, but any other indicia may be utilized. The parameter information 164 for the specimen holder speed input 134 may include the current speed setting for the cycle (e.g., 50 rpms, 80 rpms, 0 rpms/off, etc.). The specimen holder rotation speed input 134 may also be selected and the speed adjusted with the adjustment inputs 152, 154, or with another input such as a numeric pad or keyboard.

Parameter input 136 is a rotation direction input and is adjustable to set the rotation direction at which the controller 190 during a cycle operates the actuator 117 and/or 118 to rotate the platen and/or specimen holder. The rotation direction input 136 may be adjusted by toggling the input, for example, by pressing the rotation direction input 136 on the touchscreen. In embodiments, the direction input 136 may be adjusted by selecting the input and adjusting the adjustment inputs 152, 154. The direction of rotation of the platen and/or specimen holder is displayed at parameter information 166. In embodiments, the parameter information 166 includes an arrow indicating the direction, but any indicia indicative of the direction of rotation of the platen and/or the specimen holder may be desirable.

Parameter input 138 in this embodiment is a load input and is adjustable to set the force or load between the platen and specimen by causing the controller 190 during a cycle to operate the actuator 117 and/or 118 to press the platen or specimen holder into the other of the platen or the specimen holder. The load input 138 may include indicia, such as force indicia shown in FIG. 3, or other indicia as is desirable, to convey to a user that the input is associated with load setting. The parameter information 168 for load input 130 displays the force or load applied (e.g., 8 lbs, 35 N, etc.). To adjust the load, a user may select the load input 138 and then press the adjustment inputs 152 or 154 to adjust the force or load upwards or downwards. The parameter information 168 will change as the user adjusts the load with the adjustment inputs 152, 154. In one example, pressing the adjustment inputs 152, 154 a single time adjusts the load in an increment of 1 lb. In other examples, the load could be adjusted in increments of 0.5 lbs, 2 lbs, etc. In certain embodiments, the load may also be manually entered, for example, with a numeric pad input or keyboard on the screen.

Parameter inputs 140, 142 in the embodiment depicted are fluid dispenser inputs, one for water and the other for another type of fluid. Each is selectable to cause the controller 190 during a cycle to operate the dispensers 120 to dispenser water and/or other fluids. The flow rates, on/off status, or other information associated with the dispenser may be displayed at parameter information 170, 172. The flow rate and on/off is adjustable, for example, by selecting the desired input 140, 142 and adjusting with the adjustment inputs 152, 154.

The graphical user interface 126 further includes a number of other inputs, menus, settings, and so forth. For example, in the embodiment depicted, the home screen 128 includes an input 143 to access various menus, setting and other data screens. The home screen further includes a start cycle input 144 that may be selected after all the desired parameter inputs 130-142 have been selected and/or adjusted as desired to initiate a grinding/polishing cycle. When a grinding/polishing cycle is initiated, the controller 190 operates the actuators 117, 118, and the dispenser 120, as applicable, to perform a grinding/polishing cycle on one or more specimens 116 in accordance with the grinding/polishing parameters. The cycle may also be run in accordance with other parameters, which may be set by default, preprogrammed, or may not be adjustable by the user. The cycle runs for the duration selected with the cycle time input 130, or until a user manually stops a cycle, for example, with the stop cycle input 146. In embodiments, other inputs may be utilized in the graphical user interface and/or outside of the graphical user interface to intimate or stop a cycle. For example, with reference to FIG. 1, the device may include start buttons 148 to start a cycle and a stop button 150 to stop a cycle in addition to or in lieu of start/stop inputs on the graphical user interface.

Returning to FIG. 3, the home screen 128 of the graphical user interface 126 depicted also includes a number of quick-recall inputs 180-188. Quick-recall inputs 180-188 may include indicia, for example, logos, numerals, characters, graphics, and so forth. A user may operate the user interface to cause the controller to save the current grinding/polishing parameters to memory and assign the parameters to one of the quick-recall inputs 180-188. The saved parameters may be recalled quickly directly from the home screen by selecting the quick-recall input associated with the desired parameters.

More specifically, in embodiments, the user may adjust one or more grinding/polishing parameters, such as the parameters associated with the various parameter inputs 130-142, by selecting or toggling the various parameter inputs 130-142 and adjusting parameter values, for example, with the adjustment inputs 152, 154, as may be desired for a particular grinding/polishing cycle. The user may then operate the unit control panel 122 to save the selected parameters to memory and assign the selected parameters to a particular quick-recall input. In embodiments, the controller 190 saves the parameters to memory or storage device 191 (FIG. 2) and assigns the parameters to a quick-recall input 180-188 when a user presses and holds the quick-recall input for a period of time (e.g., one second or another preselected time).

The graphical user interface 126 may indicate to a user that the parameters have been saved to memory and assigned to a quick-recall input, for example, by a change in indicia on the quick-recall input, a dialogue, or the like. Each of the quick-recall inputs 180-188 may be programmed in a similar manner to associate the quick-recall inputs with a desired plurality of grinding/polishing parameters.

While five quick-recall inputs are shown in FIG. 3, any number of quick-recall inputs may be utilized. In embodiments, the quick-recall inputs are on a home screen of the graphical user interface so as to be quickly and immediately accessible to a user without, for example, requiring navigation through a menu system of the user interface. In embodiments, the quick-recall inputs appear on the home screen and appear by default when the device is turned on. In other embodiments, quick-recall inputs may additionally or alternatively be on other screens and within other menus as may be desired by various users.

A user may, as desired, perform a grinding/polishing program by operating the various quick-recall inputs in series, where the cycle associated with each quick-recall input represents a step in the program. For example, an operator may first program the quick-recall inputs 180-188, and then press the inputs 180-188 in series to perform the cycles associated with each input. In an embodiment, the user waits for the prior cycle to complete and then presses the next quick-recall input to begin the next step in the cycle, and so forth, until completed. In embodiments, a program comprising a number of steps, each step associated with a single quick-recall input, may be executed automatically by the controller upon selection of each step by the user. Moreover, any number of quick-recall inputs may be preprogrammed, for example, by the manufacture, to enable the user to perform a grinding/polishing cycle. Any of the parameter inputs may also have preprogrammed values that are selectable with the unit control pad. Many methods of control and operation may be utilized with the parameter inputs and quick-recall inputs.

Figure 4:
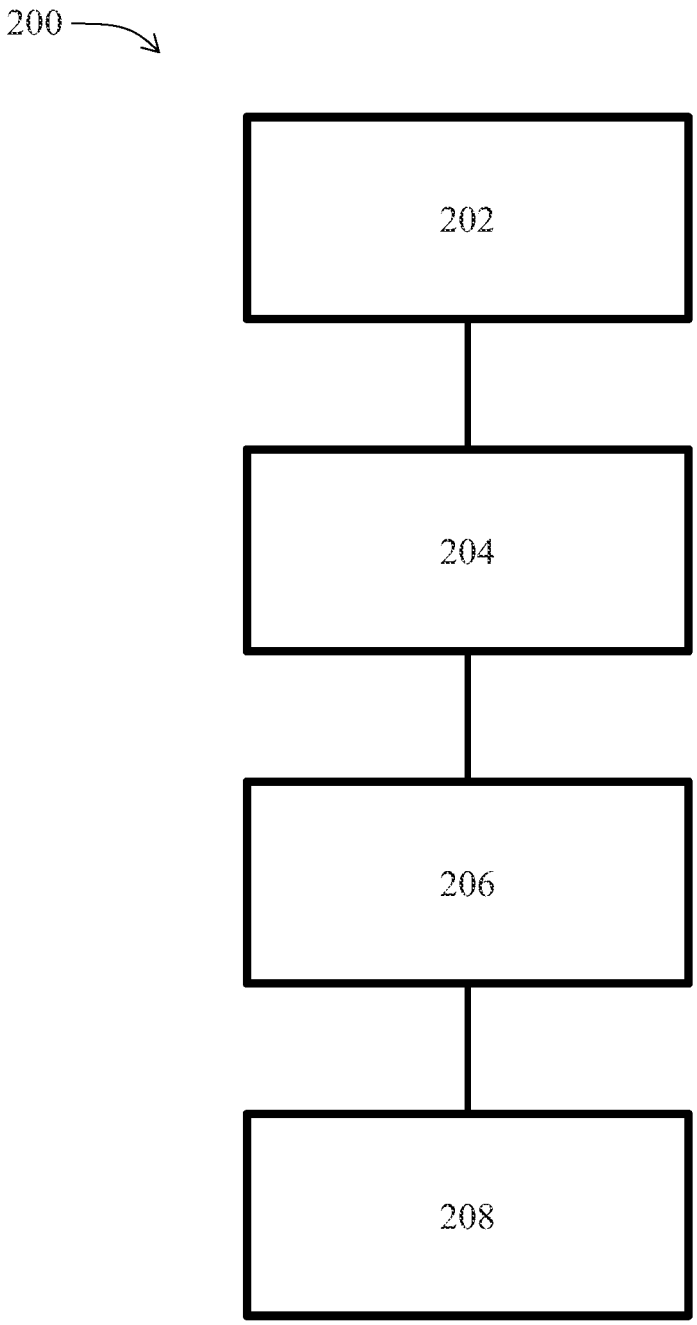
FIG. 4 illustrates a flow chart of a method of using a grinding/polishing device.

A method 200 of operating a grinding/polishing device is represented in FIG. 4 which includes executing machine readable instructions to cause a controller to perform steps 202-208. Step 202 includes saving to the machine readable storage device a plurality of user-selected grinding/polishing parameters based on grinding/polishing parameter inputs received by an input device, the grinding/polishing parameters comprising at least two of a cycle time, a platen speed, a specimen speed, a platen direction, a specimen direction, and an applied load. Step 204 includes associating the plurality of user-selected grinding/polishing parameters with one of a plurality of quick-recall inputs of an input device. Step 206 includes configuring the grinding/polishing parameters based on the grinding/polishing parameters stored in the machine readable storage device in association with the selected one of the quick-recall inputs, in response to selection of one of the quick-recall inputs of the user interface input device. Step 208 includes controlling an actuator of the grinder/polisher that is configured to move at least one of a specimen holder and a platen of the grinder/polisher to perform a grinding/polishing operation in accordance with the configured grinding/polishing parameters.

Figure 5:
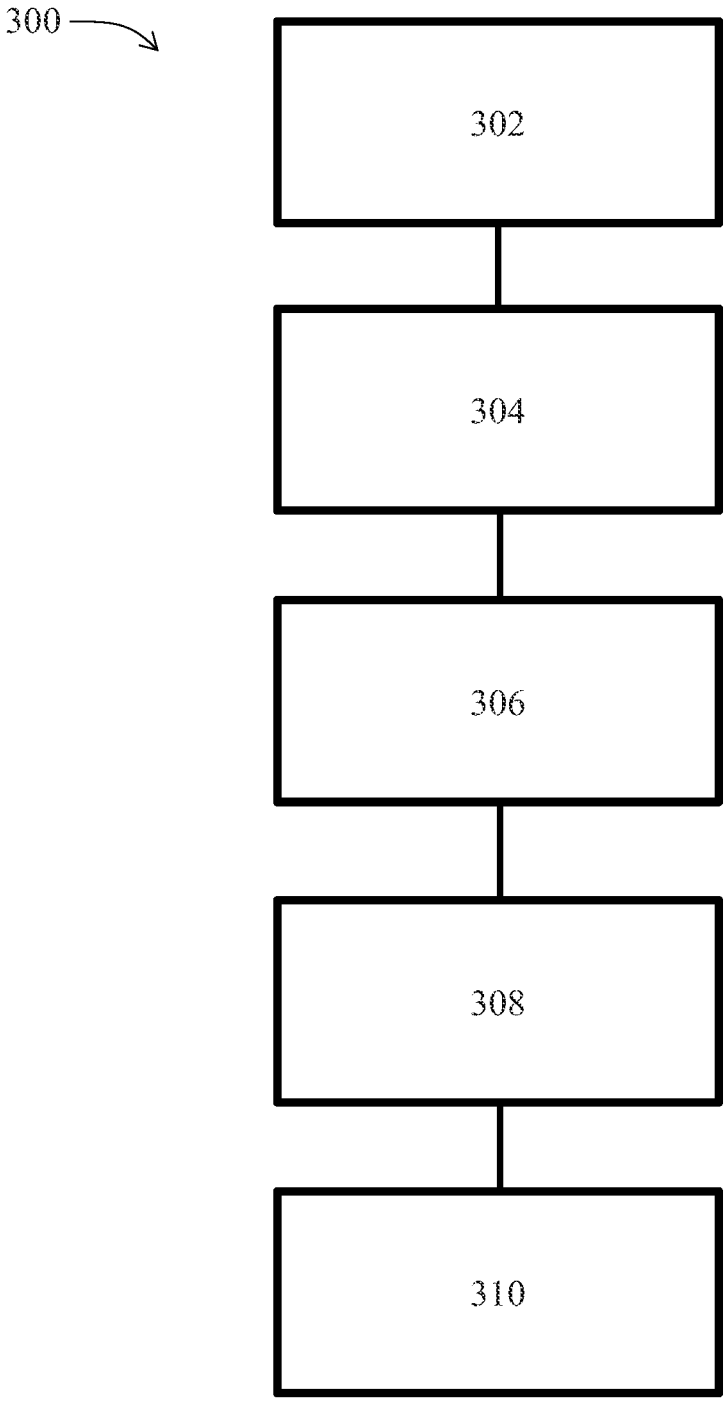
FIG. 5 illustrates a flow chart of a method of using a grinding/polishing device.

FIG. 5 represents a method 300 for operating a grinder/polisher, where the grinder/polisher includes (i) a specimen holder configured to secure a specimen, (i) a platen, (ii) an actuator configured to move at least one of the specimen holder and the platen, (iii) an input device that includes a plurality of quick-recall inputs that is configured to receive grinding/polishing parameter inputs representative of grinding/polishing parameters, where the grinding/polishing parameters comprise at least two of a cycle time, a platen speed, a specimen speed, a platen direction, a specimen direction, and an applied load, and wherein the quick-recall inputs are selectable on a same interface as the user parameter inputs, (iv) a machine readable storage device, and (v) a controller.

According to the method 300, step 302 includes saving, to the machine readable storage device, a plurality of user-selected grinding/polishing parameters based on the grinding/polishing parameter inputs received by the input device. Step 304 includes associating the plurality of user-selected grinding/polishing parameters with one of the quick-recall inputs. Step 306 includes selecting one of the quick-recall inputs. Step 308 includes configuring the grinding/polishing parameters based on the grinding/polishing parameters stored in the machine readable storage device in association with the selected one of the quick-recall inputs. Step 310 includes controlling the actuator to perform a grinding/polishing operation in accordance with the configured grinding/polishing parameters.

Steps 306 and 308, in embodiments, are repeated to program multiple quick-recall inputs, and step 310 is repeated for each quick-call input to perform multiple grinding/polishing operations, for example, in sequence, where each operation represents a step in a program. By repeating step 310 for each quick-recall input, the entire program may be executed.

Methods and systems described may be realized in hardware, software, or a combination of hardware and software. The methods and/or systems may be realized in a centralized fashion in at least one computing system or in a distributed fashion where different elements are spread across several interconnected computing systems. Any kind of computing system or other apparatus adapted for carrying out the methods described herein is suited. A typical combination of hardware and software may include a general-purpose computing system with a program or other code that, when being loaded and executed, controls the computing system such that it carries out the methods described herein. Another typical implementation may comprise an application specific integrated circuit or chip. Some implementations may comprise a non-transitory machine-readable (e.g., computer readable) medium (e.g., FLASH drive, optical disk, magnetic storage disk, or the like) having stored thereon one or more lines of code executable by a machine, thereby causing the machine to perform processes as described herein.

The foregoing description and accompanying figures illustrate the principles, preferred embodiments, and modes of operation. However, the disclosure should not be construed as being limited to the particular embodiments discussed above. Additional variations of the embodiments discussed above will be appreciated by those skilled in the art.

While the present method and/or system has been described with reference to certain implementations, it will be understood by those skilled in the art that various changes may be made and equivalents may be substituted without departing from the scope of the present method and/or system. In addition, many modifications may be made to adapt a particular situation or material to the teachings of the present disclosure without departing from its scope. For example, block and/or components of disclosed examples may be combined, divided, re-arranged, and/or otherwise modified. Therefore, the present method and/or system are not limited to the particular implementations disclosed. Instead, the present method and/or system will include all implementations falling within the scope of the appended claims, both literally and under the doctrine of equivalents. While the controllers and methods are described as being employed in connection with a grinding/polishing device, the teachings may be similarly applied to other devices where it is desirous to determine control grinding and/or polishing operations.

All documents cited herein, including journal articles or abstracts, published or corresponding U.S. or foreign patent applications, issued or foreign patents, or any other documents are each entirely incorporated by reference herein, including all data, tables, figures, and text presented in the cited documents.

What is claimed is:

1. A grinder/polisher, comprising:

a specimen holder configured to secure a specimen;

a platen;

an actuator configured to move at least one of the specimen holder and the platen;

an input device comprising a plurality of quick-recall inputs and being configured to receive grinding/polishing parameter inputs representative of grinding/polishing parameters, the grinding/polishing parameters comprising at least one of a platen direction or a specimen direction and at least one of a cycle time, a platen speed, a specimen speed, and an applied load, wherein the quick-recall inputs are selectable on a same interface as the user parameter inputs;

a machine readable storage device; and a controller configured to:

save to the machine readable storage device a plurality of user-selected grinding/polishing parameters based on the grinding/polishing parameter inputs received by the input device;

associate the plurality of user-selected grinding/polishing parameters with one of the quick-recall inputs;

in response to selection of one of the quick-recall inputs, configure the grinding/polishing parameters based on the grinding/polishing parameters stored in the machine readable storage device in association with the selected one of the quick-recall inputs; and control the actuator to perform a grinding/polishing operation in accordance with the configured grinding/polishing parameters.

2. The grinder/polisher of claim 1, further comprising a water dispenser configured to provide cooling water to the specimen, the grinder/polisher parameters further including water on/off, the controller further configured to control the water dispenser in accordance with a selected cycle time and water on/off.

3. The grinder/polisher of claim 2, wherein the actuator comprises a motor and a driver actuator, the controller further configured to control (i) the motor to rotate at least one of the specimen holder and the platen in accordance with selected grinding/polishing parameters, and (ii) the drive actuator to press the specimen or the platen into the other of the specimen and the platen in accordance with a selected load applied.

4. The grinder/polisher of claim 1, wherein the input device comprises a touch-screen display configured to display the quick-recall inputs and the plurality of grinder/polisher parameters.

5. The grinder/polisher of claim 4, wherein the touch screen includes a home screen, wherein at least one of the plurality of quick-recall inputs is displayed on and selectable from the home screen.

6. The grinder/polisher of claim 1, wherein at least one of the plurality of quick-recall inputs is accessible on a home screen of the input device without accessing a menu of the input device.

7. The grinder/polisher of claim 1, wherein at least one of the plurality of quick-recall inputs is immediately accessible to a user on a home screen of the input device.

8. A grinder/polisher, comprising:

a specimen holder configured to secure a specimen;

a platen;

an actuator configured to move at least one of the specimen holder and the platen;

an input device comprising a plurality of quick-recall inputs and being configured to receive grinding/polishing parameter inputs representative of grinding/polishing parameters, the grinding/polishing parameters comprising at least two of a cycle time, a platen speed, a specimen speed, a platen direction, a specimen direction, and an applied load, wherein the quick-recall inputs are selectable on a same interface as the user parameter inputs;

a fluid dispenser configured to provide a fluid to the specimen, the grinder/polisher parameters further including fluid on/off and fluid dispensation rate;

a machine readable storage device; and a controller configured to:

save to the machine readable storage device a plurality of user-selected grinding/polishing parameters based on the grinding/polishing parameter inputs received by the input device;

associate the plurality of user-selected grinding/polishing parameters with one of the quick-recall inputs;

in response to selection of one of the quick-recall inputs, configure the grinding/polishing parameters based on the grinding/polishing parameters stored in the machine readable storage device in association with the selected one of the quick-recall inputs;

control the actuator to perform a grinding/polishing operation in accordance with the configured grinding/polishing parameters; and control the fluid dispenser in accordance with a selected cycle time, fluid on/off, and fluid flow dispensation rate.

9. A grinder/polisher, comprising:

a specimen holder configured to secure a specimen;

a platen;

an actuator configured to move at least one of the specimen holder and the platen;

an input device comprising a plurality of quick-recall inputs and being configured to receive grinding/polishing parameter inputs representative of grinding/polishing parameters, the grinding/polishing parameters comprising at least two of a cycle time, a platen speed, a specimen speed, a platen direction, a specimen direction, and an applied load, wherein the quick-recall inputs are selectable on a same interface as the user parameter inputs, wherein the input device comprises a touch-screen display configured to display the quick-recall inputs and the plurality of grinder/polisher parameters;

a machine readable storage device; and a controller configured to:

save to the machine readable storage device, upon a user selecting and holding one of the plurality of quick-recall inputs, a plurality of user-selected grinding/polishing parameters based on the grinding/polishing parameter inputs received by the input device;

associate the plurality of user-selected grinding/polishing parameters with one of the quick-recall inputs;

in response to selection of one of the quick-recall inputs, configure the grinding/polishing parameters based on the grinding/polishing parameters stored in the machine readable storage device in association with the selected one of the quick-recall inputs; and control the actuator to perform a grinding/polishing operation in accordance with the configured grinding/polishing parameters.

10. A non-transitory machine readable storage device comprising machine readable instructions which, when executed, cause a controller to:

save to the machine readable storage device a plurality of user-selected grinding/polishing parameters based on grinding/polishing parameter inputs received by an input device, the grinding/polishing parameters comprising at least one of a platen direction or a specimen direction and at least one of a cycle time, a platen speed, a specimen speed, and an applied load;

associate the plurality of user-selected grinding/polishing parameters with one of a plurality of quick-recall inputs of an input device;

in response to selection of one of the quick-recall inputs of the user interface input device, configure the grinding/polishing parameters based on the grinding/polishing parameters stored in the machine readable storage device in association with the selected one of the quick-recall inputs; and control an actuator of a grinder/polisher that is configured to move at least one of a specimen holder and a platen of the grinder/polisher to perform a grinding/polishing operation in accordance with the configured grinding/polishing parameters.

11. The non-transitory machine readable storage device as defined in claim 10, wherein the grinder/polisher parameters further include at least one of water on/off, and the instructions, when executed, cause the controller to control the water dispenser in accordance with a selected cycle time and water on/off.

12. The non-transitory machine readable storage device as defined in claim 11, wherein the actuator comprises a motor and a driver actuator, and the instructions, when executed, cause the controller to control (i) the motor to rotate at least one of the specimen holder and the platen in accordance with selected grinding/polishing parameters, and (ii) the drive actuator to press the specimen or the platen into the other of the specimen and the platen in accordance with a selected load applied.

13. The non-transitory machine readable storage device as defined in claim 12, wherein at least one of the plurality of quick-recall inputs is immediately accessible to a user on a home screen of the input device.

14. The non-transitory machine readable storage device as defined in claim 10, wherein the input device comprises a touch-screen display, and the instructions, when executed, cause the controller to display on the touch screen the quick-recall inputs and the plurality of grinder/polisher parameters.

15. The non-transitory machine readable storage device as defined in claim 14, wherein the instructions, when executed, cause the controller to display on the touch screen display a home screen, wherein at least one of the plurality of quick-recall inputs is displayed on and selectable from the home screen.

16. The non-transitory machine readable storage device as defined in claim 10, wherein at least one of the plurality of quick-recall inputs is accessible on a home screen of the input device without accessing a menu of the user interface input device.

17. A non-transitory machine readable storage device comprising machine readable instructions which, when executed, cause a controller to:

save to the machine readable storage device a plurality of user-selected grinding/polishing parameters based on grinding/polishing parameter inputs received by an input device, the grinding/polishing parameters comprising at least two of a cycle time, a platen speed, a specimen speed, a platen direction, a specimen direction, and an applied load;

associate the plurality of user-selected grinding/polishing parameters with one of a plurality of quick-recall inputs of an input device;

in response to selection of one of the quick-recall inputs of the user interface input device, configure the grinding/polishing parameters based on the grinding/polishing parameters stored in the machine readable storage device in association with the selected one of the quick-recall inputs; and control an actuator of a grinder/polisher that is configured to move at least one of a specimen holder and a platen of the grinder/polisher to perform a grinding/polishing operation in accordance with the configured grinding/polishing parameters wherein the grinder/polisher further comprises a fluid dispenser configured to provide a fluid to the specimen, and the grinder/polisher parameters further include fluid on/off and fluid dispensation rate, and the instructions, when executed, cause the controller to control the fluid dispenser in accordance with a selected cycle time, fluid on/off, and fluid flow dispensation rate.

18. The non-transitory machine readable storage device comprising machine readable instructions which, when executed, cause a controller to:

save to the machine readable storage device a plurality of user-selected grinding/polishing parameters based on grinding/polishing parameter inputs received by an input device, the grinding/polishing parameters comprising at least two of a cycle time, a platen speed, a specimen speed, a platen direction, a specimen direction, and an applied load;

associate the plurality of user-selected grinding/polishing parameters with one of a plurality of quick-recall inputs of an input device;

in response to selection of one of the quick-recall inputs of the user interface input device, configure the grinding/polishing parameters based on the grinding/polishing parameters stored in the machine readable storage device in association with the selected one of the quick-recall inputs; and control an actuator of a grinder/polisher that is configured to move at least one of a specimen holder and a platen of the grinder/polisher to perform a grinding/polishing operation in accordance with the configured grinding/polishing parameters wherein the input device comprises a touch-screen display, and the instructions, when executed, cause the controller to display on the touch screen the quick-recall inputs and the plurality of grinder/polisher parameters, wherein the instructions, when executed, cause the controller to save to the machine readable storage device the plurality of user-selected grinder/polisher parameters upon a user selecting and holding one of the plurality of quick-recall inputs.

* * * * *